US005140114A

United States Patent [19]

Sunaga et al.

[11] Patent Number: 5,140,114

[45] Date of Patent: Aug. 18, 1992

[54] ELECTRIC CONTACT WITH BASE METAL

[75] Inventors: Mitsuo Sunaga; Kiyoshi Sekiguchi; Hisaji Shinohara; Akihiro Takahashi; Hiroshi Hikita, all of Kanagawa; Takashi Nara; Sadao Sato, both of Tokyo, all of Japan

[73] Assignees: Fuji Electric Co., Ltd., Kanagawa; Tokuriki Honten Co., Ltd., Tokyo, both of Japan

[21] Appl. No.: 680,018

[22] Filed: Apr. 2, 1991

Related U.S. Application Data

[63] Continuation of Ser. No. 416,679, Oct. 3, 1989, abandoned.

[30] Foreign Application Priority Data

Oct. 3, 1988 [JP] Japan ..... 63-249522
Jan. 17, 1989 [JP] Japan ..... 1-0892
Aug. 24, 1989 [JP] Japan ..... 63-217752

[51] Int. Cl.[5] ..... H01H 1/50; H01H 1/02

[52] U.S. Cl. ..... 200/262; 200/267; 200/265; 200/268; 200/278; 200/279

[58] Field of Search ..... 200/262, 267, 238, 263, 200/265, 268, 278, 279; 428/163, 164, 167

[56] References Cited

U.S. PATENT DOCUMENTS 2,694,126 11/1954 Binstock ..... 200/267
2,715,169 8/1955 High ..... 200/262
3,341,943 9/1967 Gwyn, Jr. ..... 200/267
3,346,951 10/1967 Gwyn, Jr. ..... 200/267
3,488,841 1/1970 Stern ..... 200/262
3,499,211 3/1970 Dubuc ..... 200/262
3,688,067 8/1972 Shibata ..... 200/265
4,803,322 2/1989 Shibata ..... 200/262

FOREIGN PATENT DOCUMENTS 141119 11/1981 Japan ..... 200/262

*Primary Examiner*—Ernest G. Cusick
*Assistant Examiner*—Keith Kupferschmid
*Attorney, Agent, or Firm*—Finnegan, Henderson, Farabow, Garrett & Dunner

[57] ABSTRACT

An electric contact with a base metal used as a switch wherein the non-welded peripheral portion of the contact is prevented from bow-like bending and from peeling off. The electric contact with a base metal having a contact promoting shape is formed by die forging of a contact material joined to the base metal by resistance welding. The composite contact material is prepared by coating the core material of Ag-oxide contact material with non-oxide contact material. The side of the material in contact with the base metal is of non-oxide contact material. The contact material may be pressed to fill a groove preformed in the base metal, welded to protrusions preformed in the base metal, welded to the bottom of a cut preformed in the base metal, or welded to bottoms of recesses preformed in the base metal.

7 Claims, 8 Drawing Sheets

ELECTRIC CONTACT WITH BASE METAL

This application is a continuation division of application Ser. No. 07/416,679, filed Oct. 3, 1989 now abandoned.

BACKGROUND OF THE INVENTION

1. Field of the Invention

The present invention relates to an electric contact with a base metal for use in a current switch, such as an electromagnetic contactor.

2. Description of the Related Art

As is known, so-called non-oxide contact materials of Ag and Ag-Ni, or Ag-oxide contact materials in which an oxide including Cd, Sn, Sb, In, Zn, Mn, Te, Bi, or the like is dispersed in Ag can be used as an electric contact (hereinafter referred to as "contact") with a base metal in a current switch. In particular, the Ag-oxide contact material exhibits excellent contact characteristics in view of deposition- and wear-resistance and, therefore, is employed mainly in a medium load range.

With the marked progress of rationalization and automation in every industrial field, mechanical equipment tends to be large and complicated. The requirements for switches for governing control over such machinery, on the other hand, include being compact in size, large in capacity, and able to withstand frequent operation. Because of frequent switching operation of equipment, the switch contact dramatically heats up to the extent that the contact is locally fused by arc and electrically-induced heat. Then, when it is out of operation, the contact is cooled down to the room temperature. The contact is, therefore, subjected to repetitions of heating and cooling cycles.

Normally, the contact is joined to a base metal when used for a switch. The contact is joined metallurgically by brazing or resistance welding.

When the contact is formed by brazing, the base metal is softened since the base metal and the contact have to be heated at high temperatures. The thickness of the base metal also has to be increased. Using the brazing method, therefore, is undesirable for reducing the switch in size. Moreover, the brazing method is unfit for mass production of switches because the automated operation of joining contacts and base metals is difficult.

A resistance welding method is superior to the brazing method because with resistance welding the base metal is less affected by heat, and the operation can be automated. Current is passed across the joint between the contact material and the base metal, and causes the material to be joined instantaneously. The contact material joined to the base metal by resistance welding is subsequently compression-molded vertically into a round or square contact.

FIG. 34 shows a process of joining a contact material to a base metal by resistance welding. FIG. 35 shows a contact formed by die forging of the contact material thus joined by, resistance welding. In FIG. 34, a contact material 1 is prepared by cutting a circular wire and laid in place on a base metal 2. Current then flows between electrodes 4A and 4B with the contact material 1 and the base metal 2 held therebetween. Due to contact resistance, electrically-induced heat is generated in the joint between the contact material 1 and the base metal 2. Thus, the joint is fused so as to weld the contact material 1 to the base metal 2 within a range of weld metal zone 3. The contact material 1 joined to the base metal 2 by resistance welding is vertically compressed by means of a mold (not shown) into a disclike contact 5 shown in FIG. 35.

Despite the advantage over the brazing method in being more easily automated and highly productive, it is still difficult to join the whole surface of the contact to the base metal by resistance welding. As is obvious from FIG. 35, the weld metal zone 3 exists only in the central portion of the contact 5 subjected to die forging. Therefore, if a large current is repeatedly turned on and off through the contact joined by resistance welding incorporated in an electromagnetic contactor, the contact 5 peels off the base metal 2, as shown in FIG. 36.

In FIG. 36, numerals 5 and 6 designate a fixed and a moving contact, respectively. The contact 5 is heated by an arc 7 when the contacts 5 and 6 are separated and contact 5 is cooled after the arc 7 is extinguished. However, the surface of the contact contracts during the course of cooling and consequently the force resulting from the concentration of the heat at the center is applied to the outer periphery of the contact 5 in such a direction as to make the outer periphery thereof peel off. Once the peeling starts, transmission of heat to the base metal 2 diminishes and this causes the contact 5 to be increasingly heated and peeled off. Ultimately, the contact may undergo abnormal wear or drop off from the basemetal 2. The arc is often driven by a magnetic force in a fixed direction (e.g., in the direction of arrow P of FIG. 36) during the period between its generation and termination. In this case, contact peeling tends to be biased toward the terminal end of the movement of the arc.

One solution to the problem of increasing the contact area is to use a large welding current. If, however, the welding current is increased, the wear of the electrodes used to supply the current also increases. As a result, the electrodes will need frequent repairs and high productivity will deteriorate.

Contact materials of Ag-oxide, such as Ag-CdO and Ag-$SnO_2$ are preferred materials. These Ag-oxide contact materials feature high arc-resistance and, therefore, high adaptability for use against a large current. Thus, the joint strength is much lower than that of non-oxide contact materials because of the presence of an interfacial oxide formed with the base metal by the Ag-oxide materials. However, Ag-oxide materials tend to readily allow contacts to peel off. The peeling may be reduced by providing a silver backing layer is provided for a contact chip to which a base metal is joined by brazing. However, this method is difficult and cannot be automated.

SUMMARY OF THE INVENTION

Accordingly, an object of the present invention is to provide a peeling-resistant electric contact made by joining a contact material to a base metal, having a contact promoting shape, by resistance welding which less thermally affects the base metal but yields excellent automated production capabilities.

Another object of the present invention is to provide a peeling-resistant electric contact made by joining to a base metal, having a contact promoting shape, a contact material made of Ag-oxide contact material which exhibits excellent electrical characteristics.

To achieve the foregoing objects, and in accordance with the purposes of the invention as embodied and broadly described herein, there is provided an electric contact with a base metal, having a contact promoting shape, the combination of which is formed by die forging of a contact material joined to the base metal by resistance welding the contact material to the contact promoting shape of the base metal, at least one side of the contact material in contact with the base metal is formed of non-oxide contact material and bites into the base metal.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

The contact material subjected to die forging fills a groove or hole preformed in the base metal close to a weld zone where the base metal and the contact material are welded together. The groove may be a series of dots.

The contact material also may be welded to protrusions preformed in a weld zone of the base metal to which the contact material is welded. In another embodiment, the contact material may be welded to the bottom of a cut preformed in and laterally across the base metal. Thus, each periphery of the contact material subjected to die forging will contact the interior wall of the cut that is most vertical and the peel resistance effect of the contact is improved. Finally, the contact material may be welded to bottoms of recesses preformed in the contact-fitting portion of the base metal. As with the previous example, each periphery of the contact material subjected to die forging will contact the interior wall of the recess that is most vertical.

A composite wire may be employed as the contact material to improve deposition- and wear-resistance. The composite wire is prepared by coating the outer periphery of a core material made of Ag-metallic oxide contact material with the non-oxide contact material. The sectional area of the non-oxide contact material may account for 5% to 35% of the total sectional area of the composite wire, as will be discussed later. Moreover, the surface layer for switching purposes should be ground after die forging to expose the core material.

Only the central portion of the contact subjected to die forging is joined to the base metal after the contact material has been welded by resistance welding. The non-welded peripheral portion of the contact peels off if the thermal distortion of the surface causes it to deform in the form of a concave contact element. If part of the periphery of the central weld zone bites into the base metal, however, the periphery is prevented from peeling off as that portion biting into the base metal hooks when the bending deformation occurs. In order to make the periphery of the contact bite into the base metal, part of the contact material should be pressed to fill holes or grooves preformed in the base metal close to a weld zone where the base metal and the contact material are welded together.

The joint surface of the contact material that joins the base metal should at least be formed of non-oxide contact material of Ag, Ag-Ni, or the like. This will secure the welding strength of the central portion of the contact. The portion biting into the base metal on the periphery of the contact resists the force applied in the direction in which it is to deform around the weld zone. However, that portion shows no resistance against the force applied in the axial direction in which it slips out after the weld zone has peeled off. If the surface of the contact material that joins the base metal is formed of a flexible Ag or Ag alloy, however, the contact material will readily fill the grooves or holes formed in the base metal, and the biting performance will be improved.

Only a non-oxide contact material of Ag, Ag-Ni, or the like may be used as the contact material to form the contact. Although the intended joint strength of the contact is improved, the electric switching performance is adversely affected. Restriction as to operating conditions, therefore, must be taken into consideration.

In view of the above, the making-breaking surface of the contact is formed of Ag-oxide contact material such as Ag-CdO, Ag-$SnO_2$, or the like and the joint surface with the base metal is formed of non-oxide contact material such as Ag, Ag-Ni, or the like. Thus, both the electric switching performance and joint strength are improved.

As explained earlier, a composite wire may be used as the contact material. It is preferred to use a composite wire prepared by coating the outer periphery of a core material made of Ag-oxide contact material as the contact material with the non-oxide contact material. The provision of such a composite wire improves weldability of the contact to the base metal because of the Ag or Ag alloy on the outer periphery of the core material and further the contact material after welding is easily bitten into the base metal at die forging. The composite wire also facilitates the fabrication of the contact since the outer periphery of the hard Ag-oxide contact material is coated and protected with the Ag or Ag alloy.

The sectional area of the non-oxide contact material is set at 5% to 35%. If the percentage is set at not higher than 5%, the core material may be exposed at the time of welding. Furthermore, decreasing the amount of contact material biting into the base metal decreases the joint strength. On the other hand, if the percentage is set at not lower than 35%, the excessive Ag or Ag alloy content decreases the deposition-resistance contact characteristics. With the percentage of non-oxide material set at 5% to 35%, the surface layer for switching purposes is ground to have the core material exposed after the contact material is subjected to die forging. Moreover, the deposition-resistance is further improved when composite wire is employed.

The provision of protrusions in the weld zone where the contact material is welded to the base metal assures that the point at which an electric current starts to flow is constant. Therefore, the welding strength is stabilized.

The contact material may be welded to the bottom of a cut preformed in and laterally across the contact-fitting portion of the base metal or to recesses preformed therein so that each periphery of the compression-molded contact material is forced to contact the inner wall of the recess. This arrangement is advantageous in that the peeling of the contact material is prevented because each peripheral edge is pressed by the wall face when it is forced to curve in the form of a bow.

The accompanying drawings, which are incorporated in and constitute a part of the specification, illustrate the presently preferred embodiments of the invention and, together with the general description given above and the detailed description of the preferred embodiments given below, serve to explain the principles of the invention.

DESCRIPTION OF THE PREFERRED EMBODIMENTS

Reference will now be made in detail to the present preferred embodiments of the invention as illustrated in the accompanying drawings.

Example 1

Figure 1A:
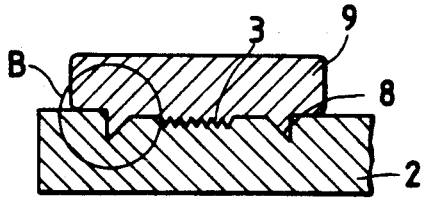
FIG. 1(A) is a sectional view of example 1 of the present invention.
Figure 1B:
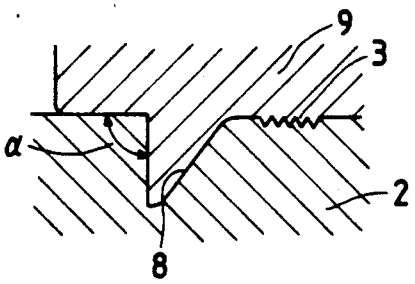
FIG. 1(B) is an enlarged view of a portion B of FIG. 1(A)
Figure 2:
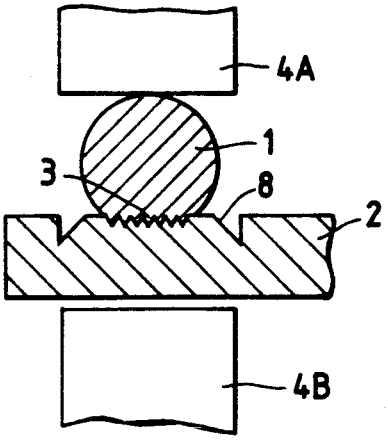
FIG. 2 is a sectional view of the contact material of the contact of FIG. 1 joined to a base metal by resistance welding.

As shown in FIG. 2, contact material 1 is prepared by cutting an Ag-Ni wire 2.6 mm in diameter to a length of 2.6 mm and laying it on a base metal 2 of 1.5 mm thick and 7.0 mm wide with grooves 8 provided close to a weld zone where the contact material 1 is welded. Contact material 1 is welded to the base metal 2 within a range of weld zone 3 by supplying power between electrodes 4A, 4B, as shown in FIG. 2. Contact material 1 is then subjected to die forging by means of a mold to make round contact 9 of 4.7 mm diameter having a flat surface as shown if FIG. 1. In FIG. 1, the contact material 1 after die forging bites into the groove 8, by pressing the contact material to fill the groove 8.

Two kinds of grooves 8 are provided in the base metal 2 as follows: two V-shaped grooves, each being 0.4 mm deep and 0.8 mm wide, are provided on both sides of contact material 1 at an interval of 3 mm as shown, and a ring-like V-shaped groove similar in depth and width and having a diameter of 3 mm is provided around the contact material 1. In addition, a base metal similar in dimensional conditions to the aforementioned samples, but free of grooves, are prepared at the same time.

These three kinds of contacts were incorporated as fixed contacts in their respective electromagnetic contactors having a rated current of 20 A and subjected to testing at 200 V, 115A. A contact having no grooves was similarly tested. The contact having no grooves started falling off at about 20,000 switchings, whereas the examples of the present invention, having the grooves, did not fall off until after 35,000 switchings.

Example 2

Figure 3A:
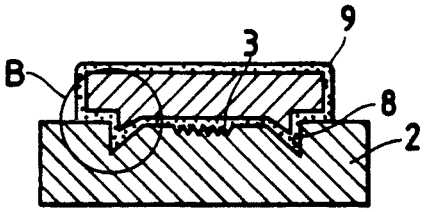
FIG. 3(A) is a sectional view of example 2 of the present invention.
Figure 3B:
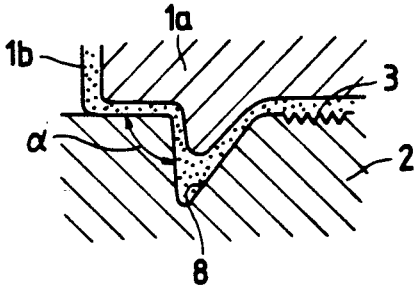
FIG. 3(B) is an enlarged view of portion B of FIG. 3(A)
Figure 4:
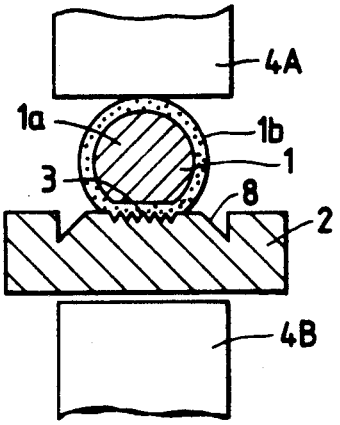
FIG. 4 is a sectional view of the contact material of the contact of FIG. 3 joined to the base metal by resistance welding.
Figure 5:
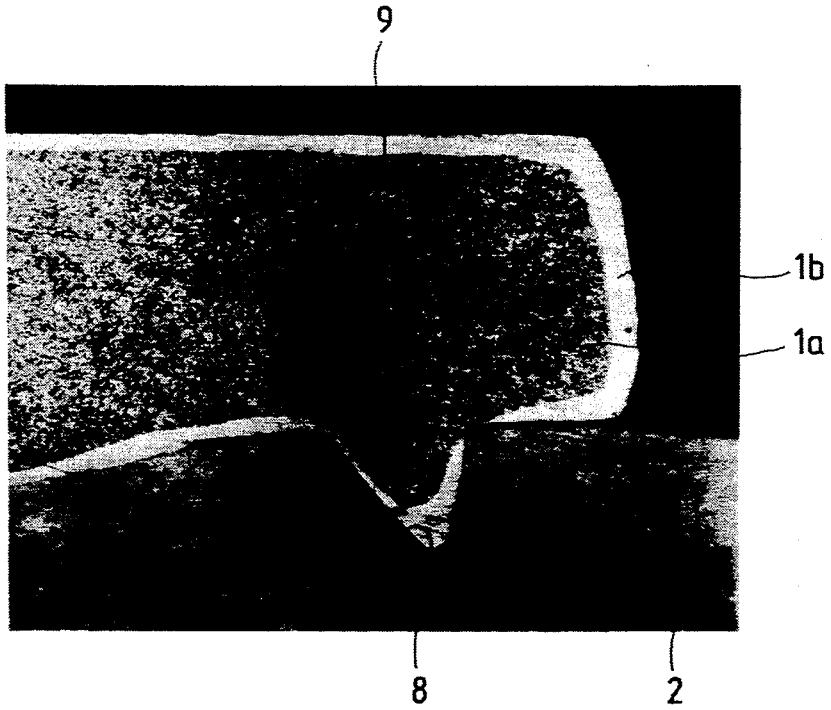
FIG. 5 is an enlarged photograph illustrating metal composition of the groove in section B of FIG. 3.

FIGS. 3 and 4 correspond to Example 2. Plus, FIG. 5 is an enlarged photograph illustrating the metal composition of the groove in section. Unlike Example 1, a composite wire of 2.6 mm in diameter, prepared by joining a silver covering material 1b 0.1 mm thick to a core material 1a of Ag-CdO, is used as contact material 1. Base metal 2, grooves 8, and contact 9 after die forging are similar to those in Example 1 in dimensions and shapes, etc.

As shown in the photograph of the groove in section, part of contact material 1, particularly silver covering material 1b is seen to have completely bitten into groove 8.

In Examples 1 and 2, the outer wall surface of groove 8 shown in FIG. 1(B) and FIG. 3(B), respectively, makes an angle of $\alpha$, which is approximately 90° to the surface of the base metal. The derivation of angle $\alpha$ from 90° should be as small as possible to increase the peel resistant effect. If the angle $\alpha$ exceeds 90°, the groove may readily be formed by punching. On the other hand, if the angle $\alpha$ is not greater than 90°, the contact material becomes virtually impossible to process. The peel resistant force of the contact generated at the time of current switching is affected by the size of current, the switching frequency, the size of contact, the material quality of the contact and so on. The angle $\alpha$, therefore, should be determined in consideration of the relationship between those conditions and the processability of the groove.

Although two parallel grooves and a ring-like groove are shown in Examples 1 and 2, the provision of only one groove on the side where the driven arc is terminated, is still effective, provided the direction of the driven arc is constant. Whether the number of grooves is increased should be determined after considering what the angle $\alpha$ will be. Moreover, silver is used in Examples 1 and 2 as coating 1b of the non-oxide contact material. However, silver alloy, which is weldable and softer than core material 1a also may be used because coating 1b is used mainly to improve the weldability of contact material 1 and to help it to bite into the groove 8.

Combinations of various composite contact materials and base metals in different shapes will be now discussed to compare the use of Ag-oxide contact material.

Composite Material (i)

A total of 10,000 g, 8,670 g of Ag and 1,330 g of Cd, are melted in a high-frequency dissolver and the molten material is reduced by water-atomizing to a powder 86.7% Ag-Cd alloy. The resulting powder is subjected to internal oxidation and formed into a round bar 80 mm in diameter and 200 mm long before being sintered.

This billet is heated at 800° C. in the atmosphere and then extruded by a hot extruder into a round bar 20 mm in diameter. The quantitive analysis value of Ag at this time is approximately 85.0% (85Ag-CdO) because of an increase in oxygen.

The round bar of Ag-CdO is fitted into an Ag pipe 1.0 mm thick and 20.1 mm in inner diameter before being heated at 800° C. Hot working is then employed to join Ag and Ag-CdO into a composite round bar.

This round composite bar is repeatedly annealed and swagged to prepare a composite wire 3.0 mm in diameter. The ratio of the Ag layer area to the total sectional area of the composite wire will be approximately 17%.

This composite wire is cut to a length of 3 mm to provide composite contact material (i).

Composite Material (ii)

A total of 10,000 g, 9,000 g of Ag powder and 1,000 g of oxidized Sn powder, are mixed by a V-type mill and the mixture is formed into a round bar 80 mm in diameter and 200 mm long before being sintered.

This billet is heated at 850° C. in the atmosphere and then extruded by a hot extruder into a round bar 20 mm in diameter (90Ag-$SnO_2$).

The round bar of Ag-$SnO_2$ is fitted into a 99.8 wt % Ag-Ni alloy pipe 2 mm thick and 20.1 mm inner diameter before being heated at 850° C. Hot working is then employed to join Ag and Ag-$SnO_2$.

This round composite bar is repeatedly annealed and swagged to prepare a composite wire 3.0 mm in diameter. The ratio of the Ag alloy layer area to the total sectional area of the composite wire will be approximately 30%. This composite wire is cut to a length of 3 mm to provide composite contact material (ii).

Composite Material (iii)

A total of 10,000 g, 9,120 g of Ag and 880 g of Cd, are melted in a high-frequency dissolver and the molten material is reduced by water-atomizing to powder 91.2% Ag-Cd alloy. The resulting powder is subjected to internal oxidation and formed into a round bar 80 mm in diameter and 200 mm in length before being sintered.

This billet is heated at 800° C. in the atmosphere and then extruded by a hot extruder into a round bar 20 mm in diameter. The quantitative analysis value of Ag at this time will be approximately 90% (90Ag-CdO) because of an increase in oxygen.

The round bar of Ag-CdO is fitted into an Ag pipe 1.5 mm thick and 20.1 mm in inner diameter before being heated at 800° C. Hot working is then employed to join Ag and Ag-CdO in to a composite round bar.

This round composite bar is repeatedly annealed and swagged to prepare a composite wire 3.0 mm in diameter. The ratio of the Ag layer area to the total sectional area of the composite wire will be approximately 24%.

This composite wire is cut to a length of 3 mm to provide a composite contact material (iii).

Composite Material (iv)

A total of 10,000 g, 8,800 g of Ag powder, 800 g of oxidized Cd powder and 400 g of oxidized Sn powder, are mixed by the V-type mill and the mixture is formed into a round bar 80 mm in diameter and 200 mm long before being sintered. This billet is heated at 850° C. in the atmosphere and then extruded by a hot extruder into a round bar 20 mm in diameter (88Ag-8CdO-$SnO_2$).

The round bar of Ag-CdO-$SnO_2$ is fitted into a 99.5 wt % Ag-Cu alloy pipe 0.5 mm thick and 20.1 mm in inner diameter before being heated at 850° C. Hot working is then employed to join Ag-Cu and Ag-CdO-$SnO_2$.

This round composite bar is repeatedly annealed and swagged to prepare a composite wire 3.0 mm in diameter. The ratio of the Ag alloy layer area to the total sectional area of the composite wire will be approximately 9%.

This composite wire is cut to a length of 3 mm to provide composite contact material (iv).

Composite Material (v)

A total of 10,000 g, 8,800 g of Ag and 1,200 g of Cd, are melted in a high-frequency dissolver and the molten material is reduced by water-atomizing to powder 88.0% Ag-Cd alloy. The resulting powder is subjected to internal oxidation and formed into a round bar 80 mm in diameter and 200 mm in length before being sintered.

This billet is heated at 800° C. in the atmosphere and then extruded by a hot extruder into a round bar 20 mm in diameter. The quantitative analysis value of Ag at this time is approximately 86.5% (86.5 Ag-CdO) because of an increase in oxygen.

The round bar of Ag-CdO is fitted into an Ag pipe 1.0 mm thick and 20.1 mm in inner diameter before being heated at 800° C.

This round composite bar is repeatedly annealed and swagged to prepare a composite wire 3.0 mm in diameter. The ratio of the Ag layer area to the total sectional area of the composite wire will be approximately 9%.

This composite wire is cut to a length of 3 mm to provide composite contact material (v).

Composite Material (vi)

A total of 10,000 g, 8,800 g of Ag powder and 1,200 g of oxidized Sn powder, are mixed by the V-type mill and the mixture is formed into a round bar 80 mm in diameter and 200 mm long before being sintered. This billet is heated at 850° C. in the atmosphere and then extruded by a hot extruder into a round bar 20 mm in diameter (88Ag-$SnO_2$).

The round bar of Ag-$SnO_2$ is fitted into a 99.5 wt % Ag-Ni alloy pipe 2 mm thick and 20.1 mm in inner diameter before being heated at 850° C. Hot working is then employed to join Ag-Ni and Ag-$SnO_2$.

This round composite bar is repeatedly annealed and swagged to prepare a composite wire 3.0 mm in diameter. The ratio of the Ag alloy layer area to the total sectional area of the composite wire is approximately 30%. This composite wire is cut to a length of 3 mm to provide a composite contact material (vi).

Although Ag-CdO and Ag-$SnO_2$ are discussed as the core materials for the contact materials i-vi, use can be made of Ag-oxide contact materials containing various oxidee including Cd, Sn, Sb, In, Zn, Mn, Te, Bi, etc.

Comparative Contact Materials

In the preparation of the aforementioned composite materials (i)–(vi), core materials made of Ag-oxide contact material were made into comparative contacts a, b, c, d, e, and f in the form of a wire 3 mm in diameter. The comparative examples were made by repeatedly annealing and extruding the material into the round bar 20 mm in diameter of 85Ag-CdO as a, 90Ag-$SnO_2$ as b, 90Ag-CdO as c, 88Ag-8CdO-$SnO_2$ as d, 86.5 Ag-CdO as e, or 88Ag-$SnO_2$ as f and outting to a length of 3 mm. As will be discussed, Examples 3–6 using contact material (i)–(iv) were compared with examples using comparative contact material a–f.

Example 3

Figure 6:
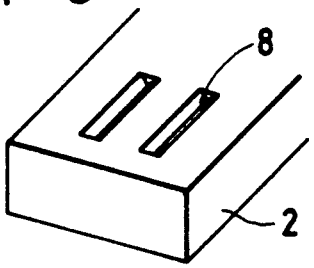
FIG. 6 is a perspective view of the principal part of a base metal of example 3 of the present invention.

As shown in FIG. 6, two V-shaped grooves 8, 0.5 mm deep×1.0 mm wide×3.0 mm long are made in the base metal 2, 1.5 mm thick×7.0 mm wide at a 3 mm interval. The aforementioned contact material (i) is joined to the base metal by resistance welding and the contact material is subjected to die forging into a substantially square contact 0.8 mm thick×5.0 mm wide. Further, the switching surface of the contact is ground to expose the Ag-CdO layer.

Example 4

Figure 7:
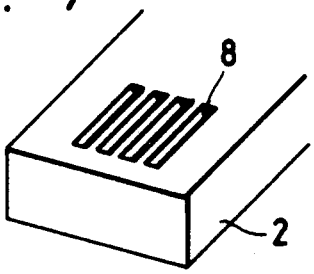
FIG. 7 is a perspective view of the principal of a base metal of example 4 of the present invention.

As shown in FIG. 7, two pairs of V-shaped grooves 8, 0.1 mm deep×0.75 mm wide×5.0 mm long are made in the base metal 2, 1.5 mm thick×7.0 mm wide at a 2 mm interval. The aforementioned contact material (ii) is joined to the base metal by resistance welding and the material is subjected to die forging into a substantially square contact 0.8 mm thick×5.0 mm wide. Further, the switching surface of the contact is ground to expose the Ag-$SnO_2$ layer.

Example 5

Figure 8:
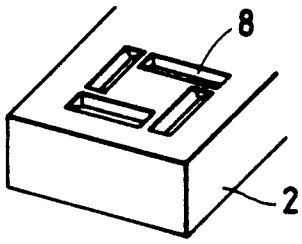
FIG. 8 is a perspective view of the principal part of a base metal of example 5 of the present invention.

As shown in FIG. 8, four V-shaped grooves 8, 0.7 mm deep×0.2 mm wide×3.0 mm long are made in the base metal 2, 1.5 mm thick×7.0 mm wide at a 2 mm interval in a square form. The aforementioned contact material (iii) is joined to the base metal by resistance welding and the material is subjected to die forging into a substantially square contact 0.8 mm thick×5.0 mm wide. Further, the switching surface of the contact is ground to expose the Ag-CdO layer.

Example 6

Figure 9:
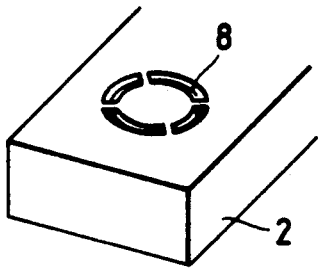
FIG. 9 is a perspective view of the principal part of a base metal of example 6 of the present invention.

As shown in FIG. 9, four V-shaped grooves 8, 0.5 mm deep×1.2 mm wide×2.8 mm long are made in the base metal 2, 1.5 mm thick×7.0 mm wide at a 2 mm interval in a ring form. The aforementioned contact material (iv) is joined to the base metal by resistance welding and the material is subjected to die forging into a substantially square contact 0.8 mm thick×5.0 mm wide per side. Further, the switching surface of the contact is ground to expose the Ag-CdO-$SnO_2$ layer.

Comparative Example 3

A comparative example of a contact material a was welded to a base metal 2 of FIG. 6 and ground as in the case of Example 3.

Comparative Example 4

A comparative example of a contact material b was welded to the base metal 2 of FIG. 7 and ground as in the case of Example 4.

Comparative Example 5

A comparative example of a contact material c was welded to the base metal 2 of FIG. 8 and ground as in the case of Example 3.

Comparative Example 6

A comparative example of a contact material d was welded to the base metal 2 of FIG. 9 and ground as in the case of Example 4.

The contacts thus obtained were incorporated in commercially available electromagnetic contactors (read at 20 A), and switched on and off 20,000 times under the conditions including voltage at AC 220 V, current at 120 A, power factor at 0.35, and switching frequency at 600 times per hour. Examples 3–6 were made as discussed above and used in a similar fashion to the comparative examples in order to comapre wear condition. Table 1 shows the results obtained. As is obvious from Table 1, the comparative examples deformed in the form of a bow because every one of them had not sufficient joint strength and fell off at about 10,000 switchings. The examples of the present invention were free from curved deformation and showed normal wear.

Example 7

Figure 10:
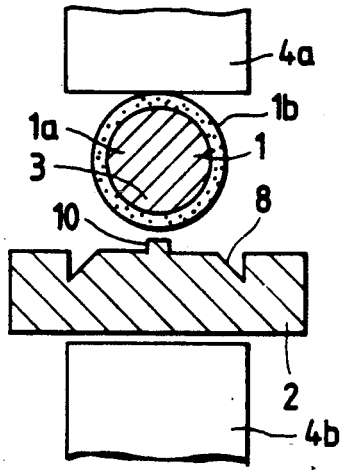
FIG. 10 is a sectional view of a contact material of example 7 of the present invention.
Figure 11:
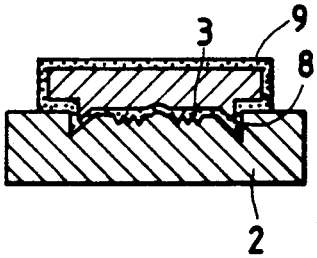
FIG. 11 is a sectional view of the compression-molded contact material of FIG. 10.
Figure 12:
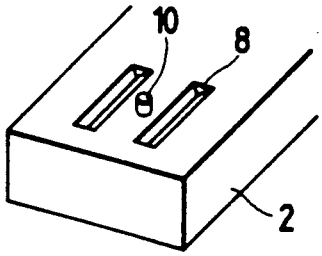
FIG. 12 is a perspective view of the base metal of FIG. 10.

As shown in FIG. 10, contact material 1 made of composite contact material (i) is welded by projection welding to the base metal 2 of FIG. 12. One protrusion 10 is provided in the contact material welding zone of FIG. 6. The material is subjected to die forging into a substantially square contact 0.8 mm thick×5.0 mm wide per side as shown in FIG. 11.

Example 8

Figure 13:
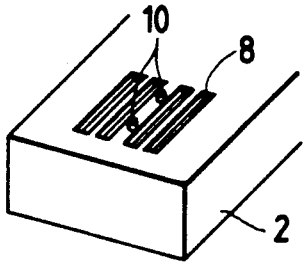
FIG. 13 is a perspective view of the principal part of a base metal of example 8.

Composite contact material (ii) is welded by projection welding to the base metal 2 of FIG. 13. Two protrusions 10 are provided in the contact material welding zone of FIG. 7. The material is subjected to die forging as in the case of Example 7.

Example 9

Figure 14:
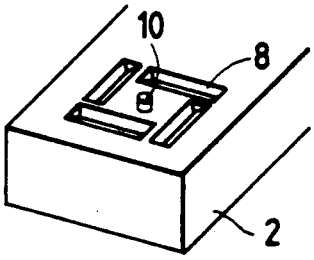
FIG. 14 is a perspective view of the principal part of a base metal of example 9.

Composite contact material (iii) is welded by projection welding to the base metal 2 of FIG. 14. One protrusion 10 is provided in the contact material welding zone of FIG. 8. The material is subjected to die forging.

Example 10

Figure 15:
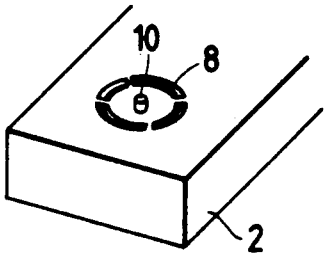
FIG. 15 is a perspective view of the principal part of a base metal of example 10.

Composite contact material (iv) is welded by projection welding to the base metal 2 of FIG. 15. One protrusion 10 is provided in the contact material welding zone of FIG. 9. The material is subjected to die forging.

In order to test Examples 7–10, Comparative Examples 7–10 were prepared by joining comparative contact materials a–d by projection welding to the base metals 2 of FIGS. 2–15 and they are subjected to die forging into substantially square contacts 0.8 mm thick×5.0 mm wide per side. Table 2 shows the test results under the same conditions as that of Examples 3–6. Examples 7–10 of the present invention were free from curved deformation and showed normal wear.

Example 11

Figure 16:
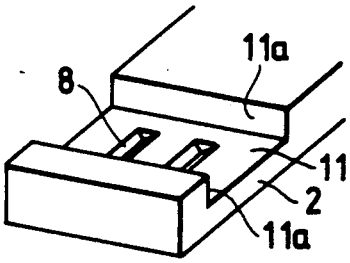
FIG. 16 is a perspective view of the principal part of a base metal of example 11.

As shown in FIG. 16, a cut 11, 1.5 mm thick×7.0 mm wide is preformed by cutting in and laterally across the contact-fitting portion of the base metal. V-shaped grooves 8 similar to those shown in FIG. 6 are provided in the bottom of the base metal. In the meantime, contact material (v) is welded to the base metal by resistance welding and the material is subjected to die forging into a substantially square contact 0.8 mm thick×5.0 mm wide per side. At this time, each peripheral edge of the contact is then forced to contact the wall surface 11*a* of the cut 11.

Example 12

Figure 17:
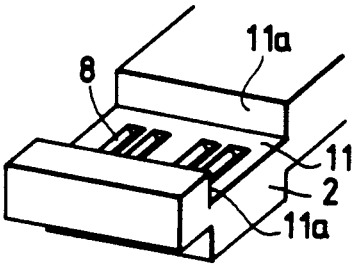
FIG. 17 is a perspective view of the principal part of a base metal of example 12.

As shown in FIG. 17, a cut 11, 1.5 mm thick×7.0 mm wide is preformed by extrusion molding laterally across the contact-fitting portion of the base metal. V-shaped grooves 8 similar to those shown in FIG. 7 are provided in the bottom of the base metal. Contact material (vi) is welded to the base metal by resistance welding and the material is subjected to die forgoing. Each peripheral edge of the contact is then forced to contact the wall surface 11*a* of the cut 11.

In order to test Examples 11 and 12, Comparative Examples 11 and 12 were prepared by joining comparative contact materials e and f by welding to the base metals 2 of FIGS. 16 and 17 and they are subjected to die forgoing so that each peripheral edge was in contact with the wall surface 11*a* of cut 11. Table 3 shows the test results under the same condition as that of Examples 3–6. Examples 11–12 of the present invention were free from curved deformation and showed normal wear.

Example 13

Figure 18:
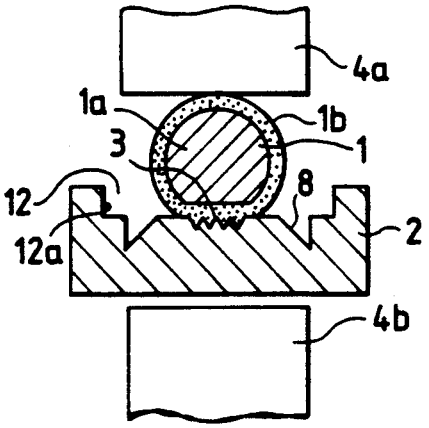
FIG. 18 is a sectional view of the contact material of example 13 joined to a base metal by welding according to the present invention.
Figure 19:
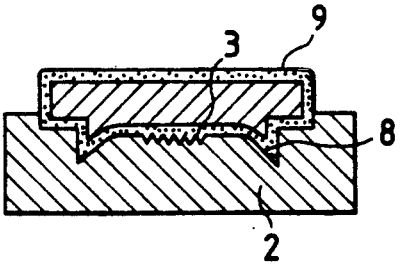
FIG. 19 is a sectional view of the compression-molded contact material of FIG. 18.
Figure 20:
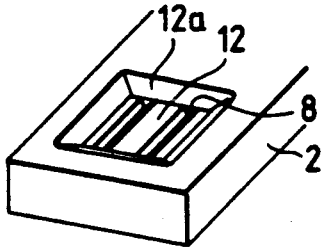
FIG. 20 is a perspective view of the principal part of the base metal of FIG. 18.

As shown in FIG. 20, a recess 12, 1.5 mm thick×7.0 mm wide is preformed by extrusion molding in and laterally across the contact-fitting portion of the base metal. V-shaped grooves 8 similar to those shown in FIG. 6 are provided in the bottom of the case metal. Contact material (i) made of the contact material 1 is welded to the base metal by resistance welding as shown in FIG. 18 and the material is subjected to die forgoing into a substantially square contact 0.8 mm thick×5.0 mm wide per side. Each peripheral edge of the contact 9 is then forced to contact the wall surface 12*a* of the recess 12.

Example 14

Figure 21:
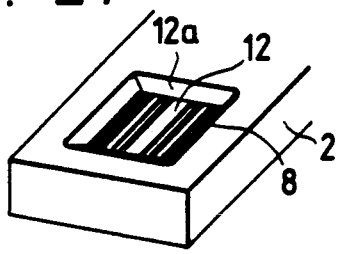
FIG. 21 is a perspective view of the principal part of a base metal of example 14.

As shown in FIG. 21, the composite contact material (ii) provided with grooves 8 similar to those shown in FIG. 7 is welded to the base metal 2 having a recess 12 similar to what is shown in FIG. 20. The material is subjected to die forging and each peripheral edge of the contact 9 is forced to touch the wall surface 12*a* of the recess 12.

Example 15

Figure 22:
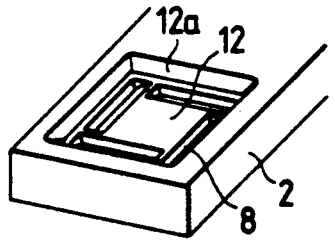
FIG. 22 is a perspective view of the principal part of a base metal of example 15.

As shown in FIG. 22, a recess 12 similar to that shown in FIG. 20 is preformed in the base metal 2 and V-shaped grooves 8 similar to those shown in FIG. 8 are provided in the bottom thereof. The composite contact material (iii) is welded to the base metal having the grooves and each peripheral edge of the contact is forced to touch the wall surface 12*a* of the recess 12.

Example 16

Figure 23:
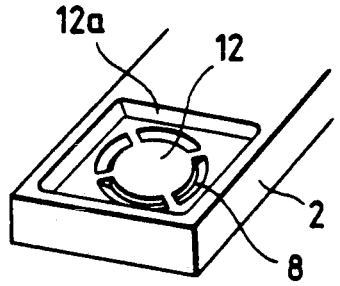
FIG. 23 is a perspective view of the principal part of a base metal of example 16.

As shown in FIG. 23, a recess 12 similar to that shown in FIG. 20 is preformed in base metal 2 and V-shaped grooves 8 similar to those shown in FIG. 9 are provided in the bottom thereof. The composite contact material (iv) is welded to the base metal having the grooves and each peripheral edge of the contact is forced to touch the wall surface 12*a* of the recess 12.

In order to test Examples 13–16, Comparative Examples 13–16 were prepared by joining comparative contact materials a-d by welding to the base metals 2 of FIGS. 20–23 and they are subjected to die forging likewise to have each peripheral edge contact the wall surface 12*a* of the recess 12. Table 4 shows the test results under the same condition as that of Examples 13–16. Examples 13–16 of the present invention were free from curved deformation and showed normal wear, whereas Comparative Examples 13–16 deformed in the form of a bow and fell off at not greater than 10,000 switchings.

Example 17

Figure 24:
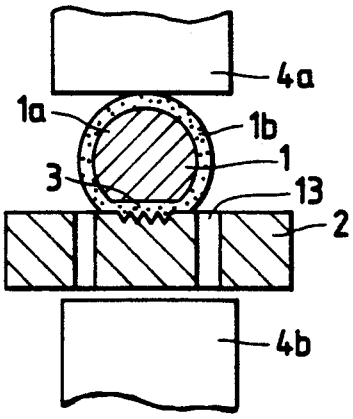
FIG. 24 is a sectional view of a contact material of example 17 joined to the base metal.
Figure 25A:
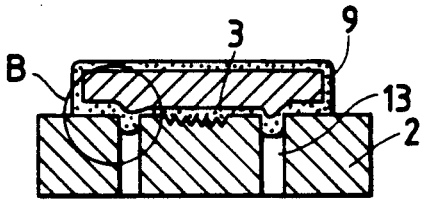
FIG. 25(A) is a sectional view of the compression-molded contact material of FIG. 24.
Figure 25B:
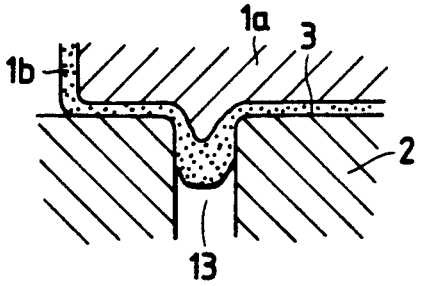
FIG. 25(B) is an enlarged view of portion B of FIG. 25(A)
Figure 26:
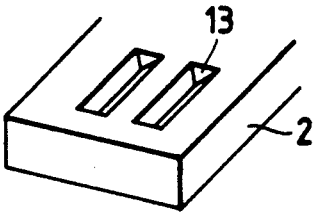
FIG. 26 is a perspective view of the principal part of a base metal of FIG. 24 and example 19 according to the present invention.

As shown in FIG. 26, the two square through-holes 13, each being 1.0 mm wide×2.0 mm long, are provided in the base metal 2, 0.6 mm thick×6.0 mm wide. Contact material 1 made of composite material of 2.6 mm in both diameter and length and made of the same material as the composite contact material (i) are joined to the base metal 2 by resistance welding as shown in FIG. 24. The material is subjected to die forging into a substantially square contact 9 of 0.7 mm thick×4.5 mm wide per side as shown in FIG. 25.

Example 18

Figure 27:
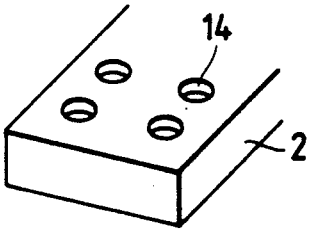
FIG. 27 is a perspective view of the principal part of the base metal of examples 18 and 20 according to the present invention.

As shown in FIG. 27, four circular through-holes 14, each being 1.0 mm in diameter, are provided in the base metal, 0.6 mm thick×6.0 mm wide. The contact material 1 made of composite material of 2.6 mm in both diameter and length and made of the same material as the composite contact material (ii) are joined to the base metal 2 by resistance welding. The material is subjected to die forging into a substantially square contact of 0.7 mm thick×4.5 mm wide per side.

Example 19

Two square through-holes 13, each being 1.0 mm wide×2.0 mm long, are provided in the base metal 2, 0.6 mm thick×6.0 mm wide (FIG. 26). The contact material 1 made of composite material of 2.6 mm in both diameter and length and made of the same material as the composite contact material (iii) are joined to the base metal 2 by resistance welding. The material is subjected to die forging into a substantially square contact of 0.7 mm thick×4.5 mm wide per side.

Example 20

Four circular through-holes 14, each being 1.0 mm in diameter, are provided in the base metal 2, 0.6 mm thick×6.0 mm wide (FIG. 27). The contact material 1 made of composite material of 2.6 mm in both diameter and length and made of the same material as the composite contact material (iv) are joined to the base metal 2 by resistance welding. The material is subjected to die forging into a substantially square contact of 0.7 mm thick×4.5 mm wide per side.

In order to test Examples 17–20, Comparative Examples 17–20 were prepared by joining comparative contact materials i–iv of 2.6 mm in both diameter and length by welding to the base metals 2 of FIGS. 26 and 27 and compression-molding them likewise.

The contacts thus obtained were incorporated in commercially available electromagnetic contactors (rated at 20 A) and switched on and off 20,000 times under the conditions including voltage at AC 220 v, current at 78 A, power factor at 0.35, and switching frequency at 600 times per hour. Examples 17–20 were made as discussed above and used in a similar fashion to the comparative examples in order to compare wear condition. Table 5 shows the results obtained. As is obvious from Table 5, Comparative Examples 17–20 deformed in the form of a bow and fell off at less than 10,000 switchings. Examples 17–20 of the present invention were free from curved deformation and showed normal wear.

Example 21

Figure 28:
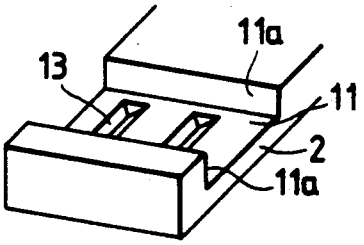
FIG. 28 is a perspective view of the principal part of the base metal of examples 21 and 23 according to the present invention.

As shown in FIG. 28, a cut 11 is preformed by cutting in and laterally across the contact-fitting portion of the base metal 2, 0.6 mm thick×6.0 mm wide and square holes 13 similar to those shown in FIG. 26 are provided in the bottom thereof. The contact material made of composite material of 2.6 mm in both diameter and length and made of the same material as the contact material (i) is joined to the base metal 2 by resistance welding and the material is subjected to die forging into a substantially square contact 0.7 mm thick×4.5 mm wide per side. Each peripheral edge of the contact is then forced to touch the wall surface 11*a* of the cut 11.

Example 22

Figure 29:
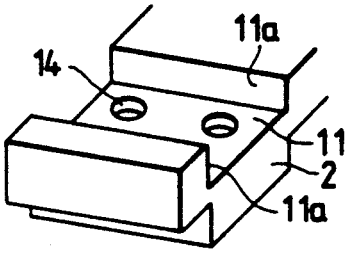
FIG. 29 is a perspective view of the principal part of the base metal of examples 22 and 24 according to the present invention.
Figure 30:
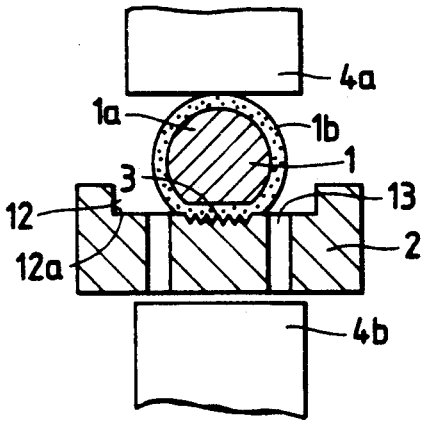
FIG. 30 is a sectional view of a contact material of example 25 joined to the base metal according to the present invention.

As shown in FIG. 29, a cut 11 is preformed by extrusion molding in and laterally across the contact-fitting portion of the base metal 2, 0.6 mm thick×6.0 mm wide and circular holes 14 base metal 2, 0.6 mm thick×6.0 mm wide and circular holes 14 similar to those shown in FIG. 27 are provided in the bottom thereof. The contact material made of composite material of 2.6 mm in both diameter and length and made of the same material as the contact material (ii) is joined to the base metal 2 by resistance welding and the material is subjected to die forging. Each peripheral edge of the contact is then forced to touch the wall surface 11*a* of the cut 11.

Example 23

Contact material made of composite material of 2.6 mm in both diameter and length and made of the same material as the contact material (iii) is joined to the base metal of FIG. 28 by welding and the material is subjected to die forging. Each peripheral edge of the contact is then forced to touch the wall surface 11*a* of the cut 11.

Example 24

Contact material made of composite material of 2.6 mm in both diameter and length and made of the same material as the contact material (iv) is joined to the base metal of FIG. 29 by welding and the material is subjected to die forging. Each peripheral edge of the contact is then forced to touch the wall surface 11*a* of the cut 11.

In order to test Examples 21–24, Comparative Examples 21–24 were prepared by joining comparative contact materials i–iv of 2.6 mm in both diameter and length by welding to the base metals 2 of FIGS. 28 and 29 and they are subjected to die forging likewise.

The contacts thus obtained were tested under the same conditions as those in the case of Examples 17–20. Table 6 shows the results obtained. As is obvious from Table 6, Comparative Examples 21–24 deformed in the form of a bow and fell off at less than 10,000 switchings. Examples 21–24 of the present invention were free from curved deformation and showed normal wear.

Example 25

Figure 32:
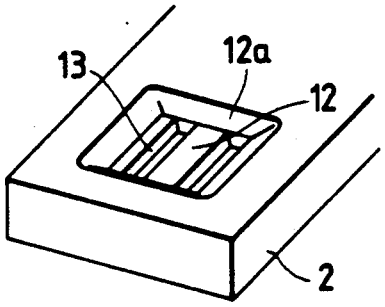
FIG. 32 is a perspective view of the principal part of the base metal of example 27 according to the present invention.
Figure 31:
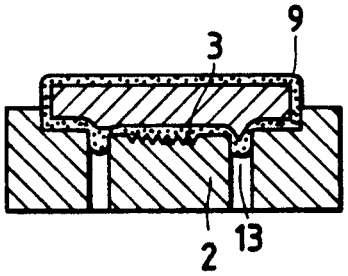
FIG. 31 is a sectional view of the compression-molded contact material of FIG. 30.
Figure 34:
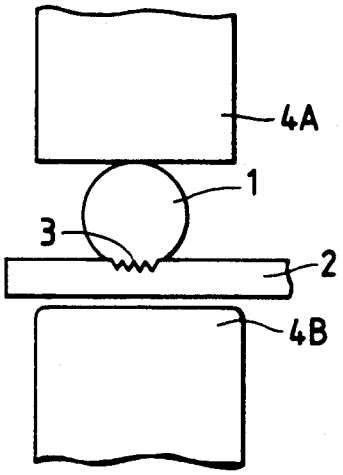
FIG. 34 is a sectional view illustrating the contact material joined by resistance welding.
Figure 35:
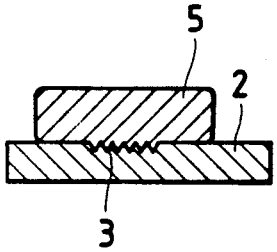
FIG. 35 is a sectional view of the compression-molded contact material of FIG. 34.
Figure 36:
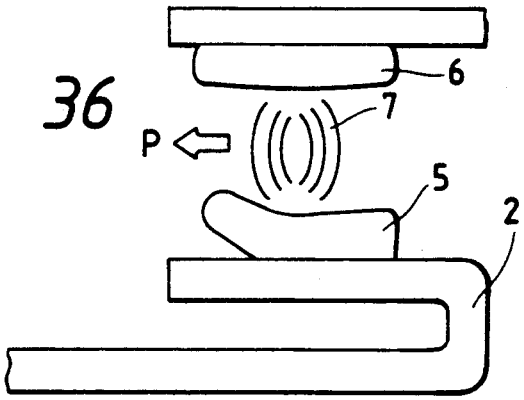
FIG. 36 is a side view illustrating the condition in which a conventional contact is caused to peel off the base metal.

As shown in FIG. 32, a recess 12 is preformed by extrusion molding in the contact-fitting portion of the base metal 2, 0.6 mm thick×6.0 mm wide and square holes 13 similar to those shown in FIG. 26 are provided in the bottom thereof. The contact materials 1 made of composite material 2.6 mm in both diameter and length made of the same material as the composite contact material (i) is joined to the base metal 2 by resistance welding and the material is subjected to die forging into a substantially square contact 9, 0.7 mm thick×4.5 mm wide per side as shown in FIG. 31. Each peripheral edge of the contact is then forced to touch the wall surface 12*a* of the recess 12 of the contact 9.

Example 26

Figure 33:
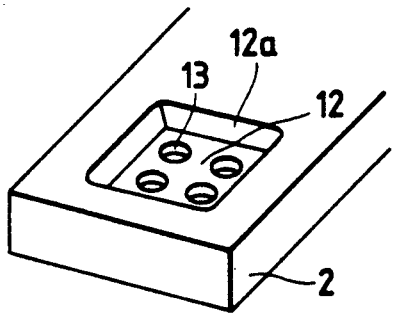
FIG. 33 is a perspective view of the principal part of the base metal of examples 26 and 28 according to the present invention.

As shown in FIG. 33, a recess 12 is performed likewise in the base metal 2 and circular holes 14 similar to those shown in FIG. 27 are provided. The contact material made of composite material of 2.6 mm in both diameter and length and made of the same material as the composite contact material (ii) is joined to the base metal 2 by welding and the material is subjected to die forging. Each peripheral edge of the contact is then forced to touch the wall surface 12a of the recess 12 of the contact.

Example 27

Contact material made of composite material of 2.6 mm in both diameter and length and made of the same material as the composite contact material (iii) is joined to the base metal of FIG. 32 by welding and the material is subjected to die forging. Each peripheral edge of the contact is then forced to touch the wall surface 12a of the recess 12 of the contact.

Example 28

Contact material made of composite material of 2.6 mm in both diameter and length and made of the same material as the composite contact material (iv) is joined to the base metal of FIG. 33 by welding and the material is subjected to die forging. Each peripheral edge of the contact is then forced to touch the wall surface 12a of the recess 12 of the contact.

In order to test Examples 25–28, Comparative Examples 25–28 were prepared by joining comparative contact materials i–iv of 2.6 mm in both diameter and length by welding to the base metals 2 of FIGS. 32 and 33 and the material are subjected to die forging.

The contacts thus obtained were tested under the same conditions as those in the case of Examples 17–20. Table 7 shows the results obtained. As is obvious from Table 7, Comparative Examples 25–28 deformed in the form of a bow and fell off at less than 10,000 switchings. Examples 25–28 of the present invention were free from curved deformation and showed normal wear.

As set forth above, the central portion of the contact is firmly welded to the base metal and the peripheral portion is prevented from bending upwardly. The contact is kept from wearing abnormally and, therefore, effectively prevented from falling off in the examples of the present invention.

It will be apparent to those skilled in the art that modifications and variations can be made to the electric contact with a base metal of the present invention. The invention in its broader aspects is, therefore, not limited to the specific details, representative methods and apparatus, and illustrated examples shown and described herein. Thus, it is intended that all matter contained in the foregoing description and shown in the accompanying drawings shall be interpreted as illustrative and not in a limiting sense.

TABLE 1

| Test Piece | Percentage of Ag Layer | Shape Of Base Metal | Amount of Wear (mg) | Wearing Condition |
|---|---|---|---|---|
| Comparative Example: | | | | |
| 3 | — | FIG. 6 | Fell off at 6,000 switchings | Bow-like bending |
| 4 | — | FIG. 7 | Fell off at 4,000 switchings | Bow-like bending |
| 5 | — | FIG. 8 | Fell off at 7,000 switchings | Bow-like bending |
| 6 | — | FIG. 9 | Fell off at 6,000 switchings | Bow-like bending |
| Invention: | | | | |
| 3 | 17 | FIG. 6 | 227 | Normal |
| 4 | 30 | FIG. 7 | 201 | Normal |
| 5 | 24 | FIG. 8 | 233 | Normal |
| 6 | 9 | FIG. 9 | 206 | Normal |

TABLE 2

| Test Piece | Percentage of Ag Layer | Shape Of Base Metal | Amount of Wear (mg) | Wearing Condition |
|---|---|---|---|---|
| Comparative Example: | | | | |
| 7 | — | FIG. 12 | Fell off at 7,000 switchings | Bow-like bending |
| 8 | — | FIG. 13 | Fell off at 7,000 switchings | Bow-like bending |
| 9 | — | FIG. 14 | Fell off at 6,000 switchings | Bow-like bending |
| 10 | — | FIG. 15 | Fell off at 8,000 switchings | Bow-like bending |
| Invention: | | | | |
| 7 | 17 | FIG. 12 | 198 | Normal |
| 8 | 30 | FIG. 13 | 206 | Normal |
| 9 | 24 | FIG. 14 | 210 | Normal |
| 10 | 9 | FIG. 15 | 225 | Normal |

TABLE 3

| Test Piece | Percentage of Ag Layer | Shape Of Base Metal | Amount of Wear (mg) | Wearing Condition |
|---|---|---|---|---|
| Comparative Example: | | | | |
| 11 | — | FIG. 16 | Fell off at 7,000 switchings | Bow-like bending |
| 12 | — | FIG. 17 | Fell off at 7,000 switchings | Bow-like bending |
| Invention: | | | | |
| 11 | 9 | FIG. 16 | 215 | Normal |
| 12 | 30 | FIG. 17 | 225 | Normal |

TABLE 4

| Test Piece | Percentage of Ag Layer | Shape Of Base Metal | Amount of Wear (mg) | Wearing Condition |
|---|---|---|---|---|
| Comparative Example: | | | | |
| 13 | — | FIG. 20 | Fell off at 6,000 switchings | Bow-like bending |
| 14 | — | FIG. 21 | Fell off at 4,000 switchings | Bow-like bending |
| 15 | — | FIG. 22 | Fell off at 7,000 switchings | Bow-like bending |
| 16 | — | FIG. 23 | Fell off at 6,000 switchings | Bow-like bending |
| Invention: | | | | |
| 13 | 17 | FIG. 20 | 205 | Normal |
| 14 | 30 | FIG. 21 | 198 | Normal |
| 15 | 24 | FIG. 22 | 216 | Normal |
| 16 | 9 | FIG. 23 | 195 | Normal |

TABLE 5

| Test Piece | Percentage of Ag Layer | Shape Of Base Metal | Amount of Wear (mg) | Wearing Condition |
|---|---|---|---|---|
| Comparative Example: | | | | |
| 17 | — | FIG. 26 | Fell off at 7,000 switchings | Bow-like bending |
| 18 | — | FIG. 27 | Fell off at 8,000 switchings | Bow-like bending |
| 19 | — | FIG. 26 | Fell off at 8,000 switchings | Bow-like bending |
| 20 | — | FIG. 27 | Fell off at 6,000 switchings | Bow-like bending |
| Invention: | | | | |
| 17 | 17 | FIG. 26 | 153 | Normal |
| 18 | 30 | FIG. 27 | 162 | Normal |
| 19 | 24 | FIG. 26 | 158 | Normal |
| 20 | 9 | FIG. 27 | 150 | Normal |

TABLE 6

| Test Piece | Percentage of Ag Layer | Shape Of Base Metal | Amount of Wear (mg) | Wearing Condition |
|---|---|---|---|---|
| Comparative Example: | | | | |
| 21 | — | FIG. 28 | Fell off at 7,000 switchings | Bow-like bending |
| 22 | — | FIG. 29 | Fell off at 8,000 switchings | Bow-like bending |
| 23 | — | FIG. 28 | Fell off at 8,000 switchings | Bow-like bending |
| 24 | — | FIG. 29 | Fell off at 6,000 switchings | Bow-like bending |
| Invention: | | | | |
| 21 | 17 | FIG. 28 | 160 | Normal |
| 22 | 30 | FIG. 29 | 158 | Normal |
| 23 | 24 | FIG. 28 | 161 | Normal |
| 24 | 9 | FIG. 29 | 165 | Normal |

TABLE 7

| Test Piece | Percentage of Ag Layer | Shape Of Base Metal | Amount of Wear (mg) | Wearing Condition |
|---|---|---|---|---|
| Comparative Example: | | | | |
| 25 | — | FIG. 32 | Fell off at 8,000 switchings | Bow-like bending |
| 26 | — | FIG. 33 | Fell off at 6,000 switchings | Bow-like bending |
| 27 | — | FIG. 32 | Fell off at 8,000 switchings | Bow-like bending |
| 28 | — | FIG. 33 | Fell off | Bow-like |

TABLE 7-continued

| Test Piece | Percentage of Ag Layer | Shape Of Base Metal | Amount of Wear (mg) | Wearing Condition |
|---|---|---|---|---|
| | | | at 6,000 switchings | bending |
| Invention: | | | | |
| 25 | 17 | FIG. 32 | 162 | Normal |
| 26 | 30 | FIG. 33 | 145 | Normal |
| 27 | 24 | FIG. 32 | 163 | Normal |
| 28 | 9 | FIG. 33 | 148 | Normal |

What is claimed is:

1. An electric contact with a base metal comprising:

an electric contact made of a preliminarily shaped contact material, said contact material being composed of an oxide metal and a non-oxide metal, wherein said contact material is a composite wire prepared by coating an outer periphery of a core material made of Ag-metallic oxide metal with said non-oxide metal; and a base metal formed to said contact material at a weld zone by resistance welding, said base metal having at least one engagement portion of unique shape close to said weld zone;

wherein at least one side of said contact material is in contact with said base metal and is formed of said non-oxide metal, and said contact material is partially welded to said base metal, is caulked to said base metal and simultaneously formed by dye forging to have a complimentary unique shape that joins with the unique shape of said engagement portion of said base metal during dye forging and, after the dye forging, a switching surface layer of said electric contact is ground to remove the non-oxide metal coating and expose the core material on the switching surface.

2. An electric contact as claimed in claim 10, wherein said unique shape of said engagement portion is a groove preformed in said base metal close to said weld zone, and said contact material is pressed at the die forging to fill said groove.

3. An electric contact as claimed in claim 1, wherein the non-oxide metal coating makes up 5% to 35% of an area of the composite wire.

4. An electric contact as claimed in claim 1, wherein said engagement portion is a hole preformed in said base metal close to said weld zone, and said contact material is pressed at the die forging to fill said hole.

5. An electric contact as claimed in claim 1, wherein said contact material is welded to protrusions preformed in said weld zone.

6. An electric contact as claimed in claim 1, wherein said contact material is welded to a bottom of a cut preformed in and laterally across said base metal, and wherein the periphery of said contact material is in contact with an inner wall of said cut after the die forging.

7. An electric contact as claimed in claim 1, wherein said contact material is welded to a bottom of a recess preformed in said base metal, and wherein the periphery of said contact material is in contact with an inner wall of said recess after the die forging.

* * * * *

UNITED STATES PATENT AND TRADEMARK OFFICE

CERTIFICATE OF CORRECTION

PATENT NO. : 5,140,114

DATED : August 18, 1992

INVENTOR(S) : Mitsuo Sunaga et al.

It is certified that error appears in the above-identified patent and that said Letters Patent is hereby corrected as shown below:

On title page, item [30], Priority Data, change "1-0892" to --1-8092--

On title page, item [30], Priority Data, change "63-217752" to --1-217752--.

Abstract, line 6, Delete "of".

Claim 1, column 18, line 30, change "dye" to --die--.

Claim 1, column 18, line 33, change "dye" to --die--.

Claim 1, column 18, line 34, change "dye" to --die--.

UNITED STATES PATENT AND TRADEMARK OFFICE

CERTIFICATE OF CORRECTION

PATENT NO. : 5,140,114

DATED : August 18, 1992

INVENTOR(S) : Mitsuo Sunaga et al

It is certified that error appears in the above-indentified patent and that said Letters Patent is hereby corrected as shown below:

Claim 2, column 18, line 38, change "claim 10, to --claim 1--.

Signed and Sealed this

Fifth Day of October, 1993

*Attest:*

*Attesting Officer*

Bruce Lehman

BRUCE LEHMAN

*Commissioner of Patents and Trademarks*